US007119821B2

(12) United States Patent
Mogi

(10) Patent No.: US 7,119,821 B2
(45) Date of Patent: Oct. 10, 2006

(54) COLOR THERMAL PRINTER AND COLOR THERMAL PRINTING METHOD

(75) Inventor: Shusuke Mogi, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 202 days.

(21) Appl. No.: 10/809,495

(22) Filed: Mar. 26, 2004

(65) Prior Publication Data

US 2004/0189784 A1 Sep. 30, 2004

(30) Foreign Application Priority Data

Mar. 26, 2003 (JP) ..... 2003-086333

(51) Int. Cl.
*B41J 2/32* (2006.01)

(52) U.S. Cl. ..... 347/171

(58) Field of Classification Search ..... 347/171, 347/176, 184, 37; 400/120.02, 225, 82
See application file for complete search history.

(56) References Cited

U.S. PATENT DOCUMENTS 4,605,938 A * 8/1986 Matsuno et al. ..... 347/176
5,153,605 A * 10/1992 Ohara et al. ..... 347/184
5,611,629 A * 3/1997 Paranjpe ..... 400/82
5,700,096 A * 12/1997 Satoh et al. ..... 400/225
5,820,274 A * 10/1998 Fukuoka et al. ..... 400/120.02
6,474,886 B1 11/2002 Sugiyama et al.
6,554,394 B1 * 4/2003 Yamaguchi et al. ..... 347/37

* cited by examiner

*Primary Examiner*—K. Feggins
(74) *Attorney, Agent, or Firm*—Sughrue Mion, PLLC

(57) ABSTRACT

In a color thermal printer, printing units for each color image are disposed along transporting path of recording sheet. In each printing unit, a thermal head and a platen roller are provided. Recording sheet is pressed on the thermal head by the platen roller and thermal head executes heat recording on recording sheet. The platen roller is provided with a pulse encoder for detecting transporting speed fluctuation amount thereof. Sheet transporting correction quantity is determined from a relation with the transporting speed fluctuation amount. The sheet transporting correction quantity is serially accumulated for the length of the recoding area, to correct recording start position of the color image to print next. Therefore, occurrence of registration deviation caused from heat deformation of the platen roller is suppressed, thereby to obtain high quality printing.

23 Claims, 5 Drawing Sheets

COLOR THERMAL PRINTER AND COLOR THERMAL PRINTING METHOD

BACKGROUND OF THE INVENTION

1. Field of the Invention

The present invention relates to a color thermal printer and color thermal printing method, and more particularly, relates to a color thermal printer and color thermal printing method for suppressing deviation of color registration.

2. Explanation of the Prior Art

One-pass type printing is used for a color thermal printer, in which full color image is recorded by executing thermal recording of yellow, magenta and cyan images in sequence when recording sheet passes a plurality of thermal heads. In one-pass type printing, full color image is printed on a plurality of recording areas which are serially provided in a feeding direction of recording sheet, and margins created between the recording areas are cut to produce a plurality of color prints.

In one-pass type color thermal printer, a plurality of thermal heads are serially pressed on recording sheet, so that tension imposed on recording sheet successively fluctuates. Accordingly, the transporting quantity and expansion and contraction quantities of recording sheet fluctuate, and inconsistency in density is likely to occur in printing by the thermal head disposed upstream. U.S. Pat. No. 6,474,886 discloses a color thermal printer of one-pass type, in which a couple of tension rollers are disposed close to each thermal head for imposing tension on recording sheet.

However, there occurs color registration deviation (hereinafter referred to as only a registration deviation) even for a color thermal printer, in which tensioning fluctuation of recording sheet during recording is suppressed by using such as the tension roller couple as described above. Particularly, the registration deviation occurs in continuous printing by such as a color thermal printer of one-pass type.

SUMMARY OF THE INVENTION

As is described heretofore, the above registration deviation causes by deformation of the platen roller. It means that registration deviation is directly caused from the situation that as temperature of the platen roller rises due to continuous printing, the platen roller is deformed to fluctuate a path length of each printing unit.

An object of the present invention is to provide a color thermal printer in which occurrence of registration deviation or error is suppressed, thereby to obtain high quality printing.

To attain the above objects, a color thermal printer of the present invention for recording full color image by recording each color image at each printing unit during transportation of a recording sheet by a transporting roller couple, a plurality of the printing units being disposed along the transporting path, each of said printing units including a platen roller for supporting long recording sheet, and a thermal head for executing thermal recording of each color image by pressed on said recording sheet which is supported by said platen roller includes a rotating speed detector and a controller. The rotating speed detector is provided on the platen roller for detecting rotating speed of the platen roller. The controller records image by driving a thermal head of each printing unit when transporting quantity of recording sheet which is transported by a transporting roller couple reaches target value corresponding to the recording start position. Moreover, the controller calculates the transporting correction quantity of recording sheet from the rotating speed fluctuation amount of the platen roller, to correct the target value corresponding to the recording start position of a directly downstream printing unit.

According to the preferred embodiment of the present invention, the rotating speed detector is a pulse encoder which outputs pulse signal according to the rotating amount of the platen roller.

According to the preferred embodiment of the present invention, first, second and third printing units are disposed from upstream of transporting path in sequence on one another for respectively recording yellow, magenta and cyan images, and the rotating speed detector is provided on the platen roller of the first and second printing units.

BRIEF DESCRIPTION OF THE DRAWINGS

The above and other objects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE EMBODIMENTS

Figure 1:
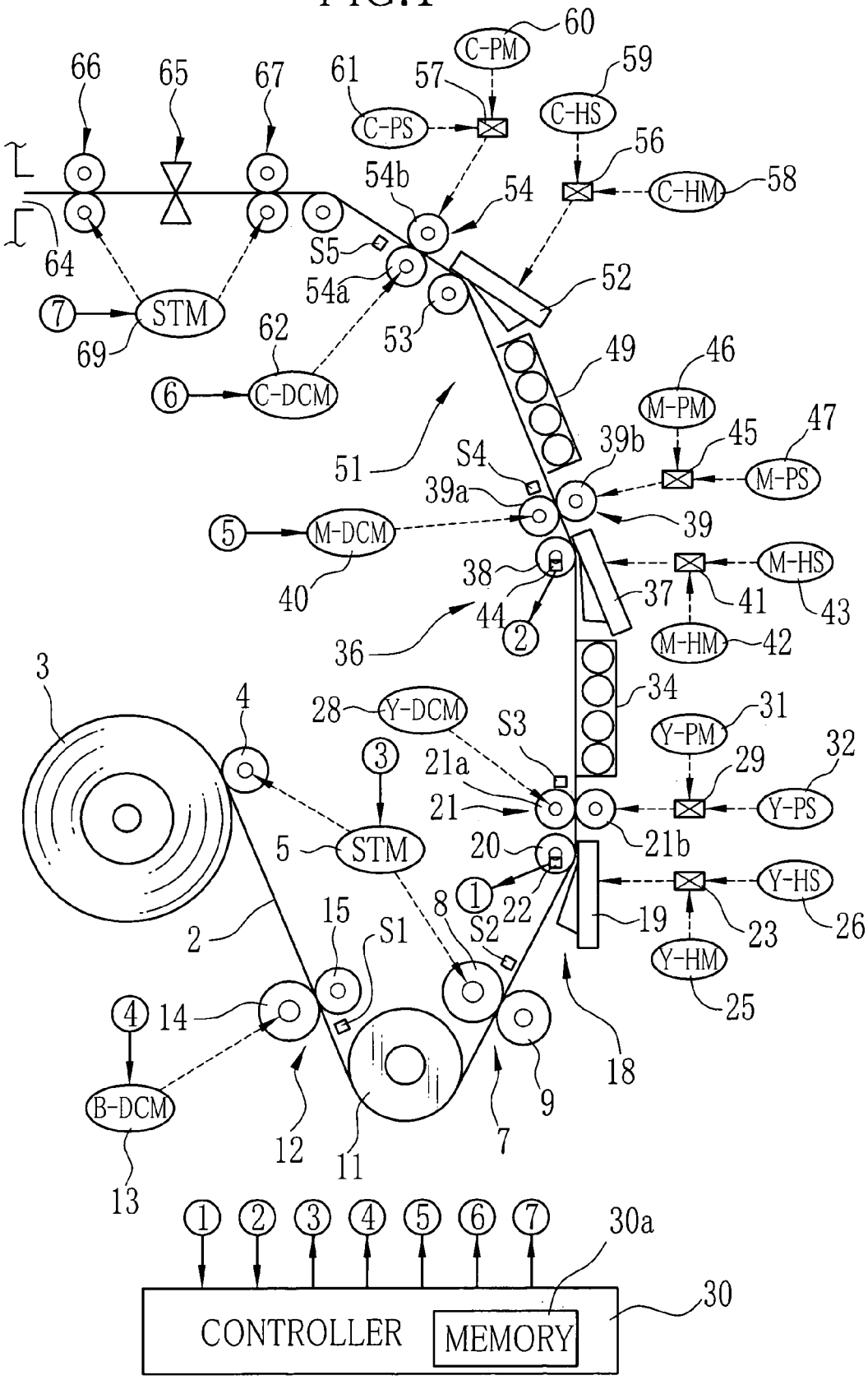
FIG. 1 is a schematic diagram illustrating a color thermal printer of the present invention.

FIG. 1 is a schematic diagram illustrating a color thermal printer of the present invention. The printer is loaded with a roll 3 of long color thermo sensitive recording sheet 2 being wound as a recording medium. The roll 3 is set at a supply portion of the color thermal printer and a sheet supply roller 4 presses the perimeter of the roll 3.

A stepping motor (STM) 5 drives to rotate the sheet supply roller 4 to rotate the roll 3. Recording sheet 2 is pulled from the roll 3 to be transported to a sheet discharge opening in a supply direction through a transporting path. When printing is completed, the sheet supply roller 4 rewinds recording sheet 2 around the roll 3 for preventing damage from light or humidity.

It is well known that recording sheet 2 includes a cyan thermal coloring layer, a magenta thermal coloring layer, and a yellow thermal coloring layer, overlaid on a support in sequence on one another. The yellow thermal coloring layer as a topmost layer, which is highest in heat sensitivity among three thermal coloring layers, is colored yellow with small heat energy. The cyan thermal coloring layer as a lowermost layer, which is lowest in heat sensitivity among three thermal coloring layers, is colored cyan with large heat energy. The yellow thermal coloring layer loses its coloring ability when near ultraviolet rays are irradiated in a wavelength region in which the peak value is 420 nm. The magenta thermal coloring layer is colored with medium-heat energy between the yellow and cyan thermal coloring layers and loses its coloring ability when near ultraviolet rays are irradiated in a wavelength region in which the peak value is 365 nm. Recording sheet 2 may include an extra coloring layer such as a black layer, in addition to the above yellow, magenta and cyan thermal coloring layers.

A couple of transporting rollers 7 are disposed in the transporting path for pinching and transporting recording sheet 2. The transporting roller couple 7 consists of a capstan roller 8 and a pinch roller 9. The capstan roller 8 is rotated by a stepping motor 5 and the pinch roller 9 presses the capstan roller 8 to pinch recording sheet 2. The pinch roller 9 is shiftable between the position pressed on the capstan roller 8 and the position separated from the capstan roller 8 by a shift mechanism (not shown) made of a cam or a solenoid.

An aligning roller 11 is disposed upstream of the transporting roller couple 7 in the supply direction, for correcting deviation in a widthwise direction of recording sheet 2. A back tension roller couple 12 is disposed upstream of the aligning roller 11 for applying back tension to recording sheet 2 which is being transported in the supply direction.

The back tension roller couple 12 consists of a capstan roller 14 and a pinch roller 15. The capstan roller 14 is rotated by a DC motor (B-DCM) 13 and the pinch roller 15 presses the capstan roller 14 to pinch recording sheet 2. The pinch roller 15 is shiftable between the pressed position on the capstan roller 14 and the separated position from the capstan roller 14 by a shift mechanism (not shown).

A yellow printing unit 18 is disposed downstream of the transporting roller couple 7 in the supply direction. The yellow printing unit 18 consists of a yellow thermal head 19, a platen roller 20 and a yellow front tension roller couple 21. The thermal head 19 is pressed on recording sheet 2 to print yellow image on the yellow thermal coloring layer. The platen roller 20 pinches recording sheet 2 with the thermal head 19. The yellow front tension roller couple 21 pinches and transports recording sheet 2.

The thermal head 19 is movable between the recording position where a heating element array of the thermal head 19 is pressed on recording sheet 2 to be printed and the separated position where the thermal head 19 is separated from recording sheet 2 to form a clearance from the platen roller 20. The movement of the thermal head between the recording position and the separated position is performed by a yellow head moving mechanism 23. The yellow head moving mechanism 23 consists of such as a cam which presses and moves the thermal head 19.

Figure 2:
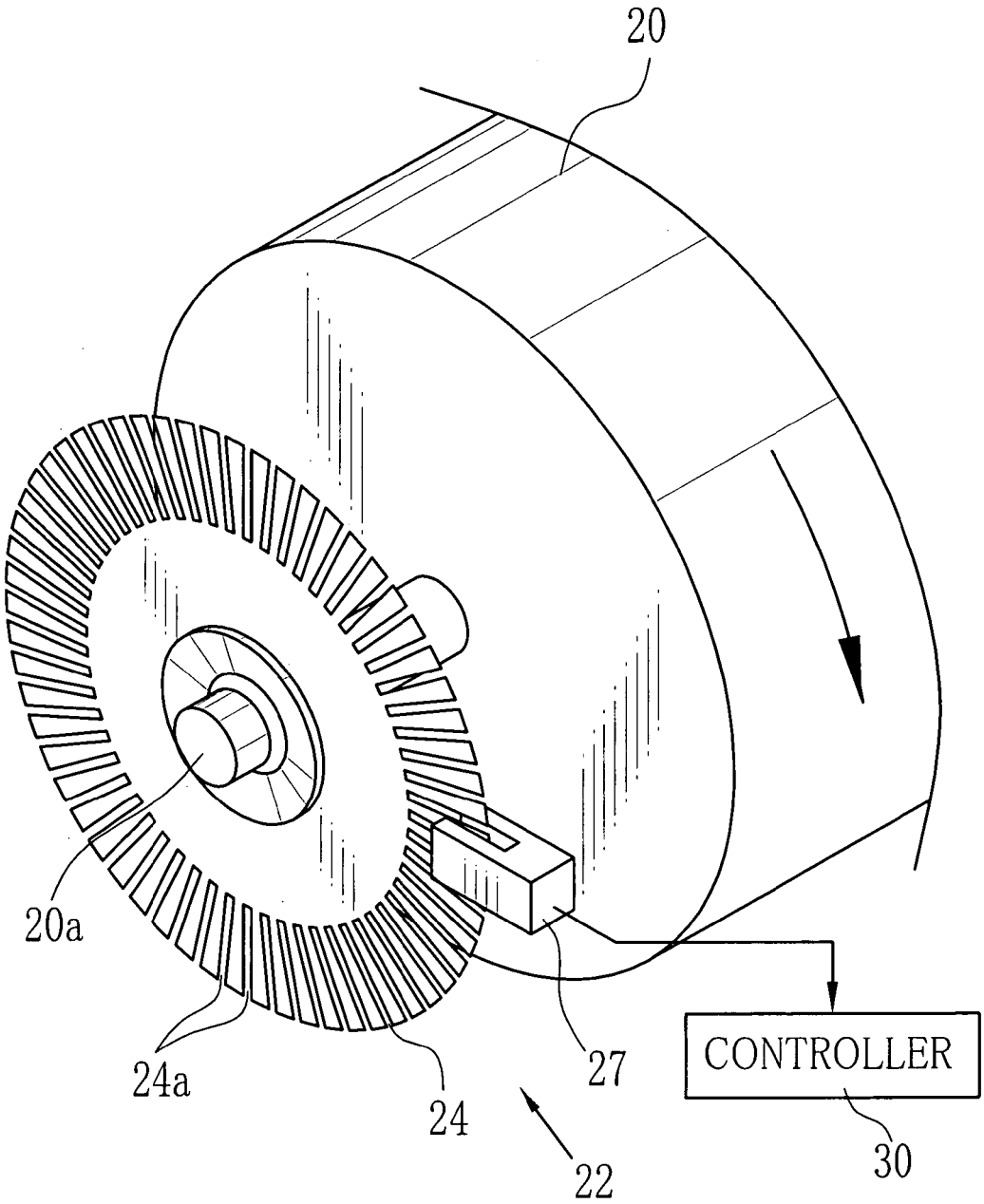
FIG. 2 is a perspective view illustrating a pulse encoder provided on platen roller.

The platen roller 20 is provided with a pulse encoder 22. In FIG. 2, the pulse encoder 22 consists of a disk-shaped slit plate 24 and a slit-detecting sensor 27. The slit plate 24 is fixed on a pivot 20*a* of the platen roller 20 with a number of slits 24*a* formed on the perimeter thereof at same intervals in a radial direction. The slit-detecting sensor 27 is composed of for example a photoelectric sensor of a transmission type, in which detecting pulse occurs each time of detecting passage of each slit 24*a* of the slit plate. The detecting pulse signal from the pulse encoder 22 is transmitted to a controller 30. Further, the pulse encoder may be composed of a rotating plate having a number of reflection marks in place of the slits 24*a* and a photoelectric sensor of a reflection-type (See FIG. 6). In FIG. 1, the yellow head moving mechanism 23 is driven by a yellow head motor (Y-HM) 25 using for example a DC motor. Position of the thermal head 19 is detected by a yellow head sensor (Y-HS) 26 using for example a photoelectric sensor of a reflection type.

The yellow front tension roller 21 consists of a capstan roller 21*a* and a pinch roller 21*b*. The capstan roller 21*a* is rotated by a yellow DC motor (Y-DCM) 28. The pinch roller 21*b* is pressed on the capstan roller 21*a* to pinch recording sheet 2. The pinch roller 21*b* is movable between the position pressed on the capstan roller 21*a* and the position separated from the capstan roller 21*a* by a yellow shift mechanism 29.

The yellow shift mechanism 29 consists of such as a cam which presses and moves the pinch roller 21*b* to be moved. The yellow shift mechanism 29 is driven by the yellow pinch motor (Y-PM) 31 using for example a DC motor. Position of the pinch roller 21*b* is detected by the yellow pinch sensor (Y-PS) 32 using for example a photoelectric sensor of a reflection type.

The yellow front tension roller couple 21 transports recording sheet 2 downstream in the supply direction. The yellow front tension roller couple 21 is set to be faster than the transporting roller couple 7 in transporting speed of recording sheet 2. However, the transporting roller couple 7 controls the transporting quantity of the yellow front tension roller couple 21. Therefore, the transporting speed of recording sheet 2 downstream of the transporting roller couple 7 is kept at the transporting speed of the transporting roller couple 7.

Moreover, since the back tension roller couple 12 generates back tension as much as front tension generated by the yellow front tension roller couple 21, tension imposed on the transporting roller couple 7 becomes less. Therefore, transporting speed of the transporting roller couple 7 is stabilized at all times.

A yellow fixing lamp 34 is disposed downstream of the yellow printing unit 18. The yellow fixing lamp 34 irradiates near ultraviolet rays in which the peak value is 420 nm, to fix the yellow thermal coloring layer of recording sheet 2.

A magenta printing unit 36 is disposed downstream of the yellow fixing lamp 34. The magenta printing unit 36 consists of a thermal head 37, a platen roller 38 and a magenta front tension roller couple 39. As in the case of the yellow printing unit 18, the thermal head 37 is pressed on recording sheet 2 to print magenta image on a magenta thermal coloring layer. The platen roller 38 pinches recording sheet 2 with the thermal head 37 and the magenta front tension roller couple 39 pinches and transports recording sheet 2. A magenta DC motor (M-DCM) 40 drives a capstan roller 39*a* of the magenta front tension roller couple 39.

The thermal head 37 is movable between the recording position and separated position by a magenta head moving mechanism 41 and a magenta head motor (M-HM) 42, in which the magenta head moving mechanism 41 has same configuration as the yellow head moving mechanism 23. A magenta head sensor (M-HS) 43 is used for detecting position of the thermal head 37.

The platen roller 38 is provided with a pulse encoder 44 which has same configuration as that in the yellow printing unit 18. The pulse encoder 44 generates pulse signal according to the rotating amount of the platen roller 38 and the pulse signal is transmitted to the controller 30.

A pinch roller 39*b* of the magenta front tension roller couple 39 is movable between the pressed position where the pinch roller 39*b* is pressed on the capstan roller 39*a* and the separated position where the pinch roller 39*b* is separated from the capstan roller 39*a* by a magenta shift mechanism 45 having same configuration as the yellow shift mechanism 29 of the yellow printing unit 18. The magenta shift mechanism 45 is driven by a magenta pinch motor (M-PM) 46 and position of the pinch roller 39*b* is detected by a magenta pinch sensor (M-PS) 47.

A magenta fixing lamp 49 is disposed downstream of the magenta printing unit 36. The magenta fixing lamp 49 irradiates near ultraviolet rays in which the peak value is 365 nm, to fix the magenta thermal coloring layer.

A cyan printing unit 51 is disposed downstream of the magenta fixing lamp 49. The cyan printing unit 51 consists of a cyan thermal head 52, a platen roller 53 and a cyan front tension roller couple 54. The cyan thermal head 52 is pressed on recording sheet 2 to print cyan image on a cyan thermal coloring layer. The platen roller 53 pinches recording sheet 2 with the cyan thermal head 52 and the cyan front tension roller 54 pinches and transports recording sheet 2. A cyan DC motor (C-DCM) 62 drives a capstan roller 54*a* of the cyan front tension roller 54. Note that cyan image is a final printing among yellow, magenta and cyan images, so that it is not required to consider registration deviation or error. Accordingly, the platen roller 53 of the cyan printing unit 51 is not provided with pulse encoders 22 and 44 as those in other printing units. If a black thermal coloring layer is provided in addition to the yellow, magenta and cyan thermal layers and printed after the cyan thermal coloring layer, a fixing lamp for completely fixing the cyan thermal coloring layer and a pulse encoder on the platen roller 53 are provided, to detect fluctuation in the sheet transporting quantity caused by the platen roller 53.

The thermal head 52 and a pinch roller 54*b* are respectively moved by a cyan head moving mechanism 56 and a cyan shift mechanism 57 which have same configuration as those used in the yellow printing unit 18 and the magenta printing unit 36. The cyan head moving mechanism 56 is driven by a cyan head motor (C-HM) 58, and position thereof is detected by a cyan head sensor (C-HS) 59. The shift mechanism 57 is driven by a cyan pinch motor (C-PM) 60, and position thereof is detected by a cyan pinch sensor (C-PS) 61.

A discharge opening 64 is provided at the downstream end of the transporting path in the supply direction, for discharging printed recording sheet 2. A cutter 65 is disposed upstream of the discharge opening 64 for cutting the long recording sheet 2 into sheets at the predetermined position. A discharge roller couple 66 and a cutter roller couple 67 are disposed in front and in rear of the cutter 65. The discharge roller couple 66 discharges recording sheet 2 from the discharge opening 64 and the cutter roller couple 67 transports recording sheet 2 toward the cutter 65. The discharge roller couple 66 and the cutter roller couple 67 are driven by a stepping motor 69.

Figures 3A, 3B:
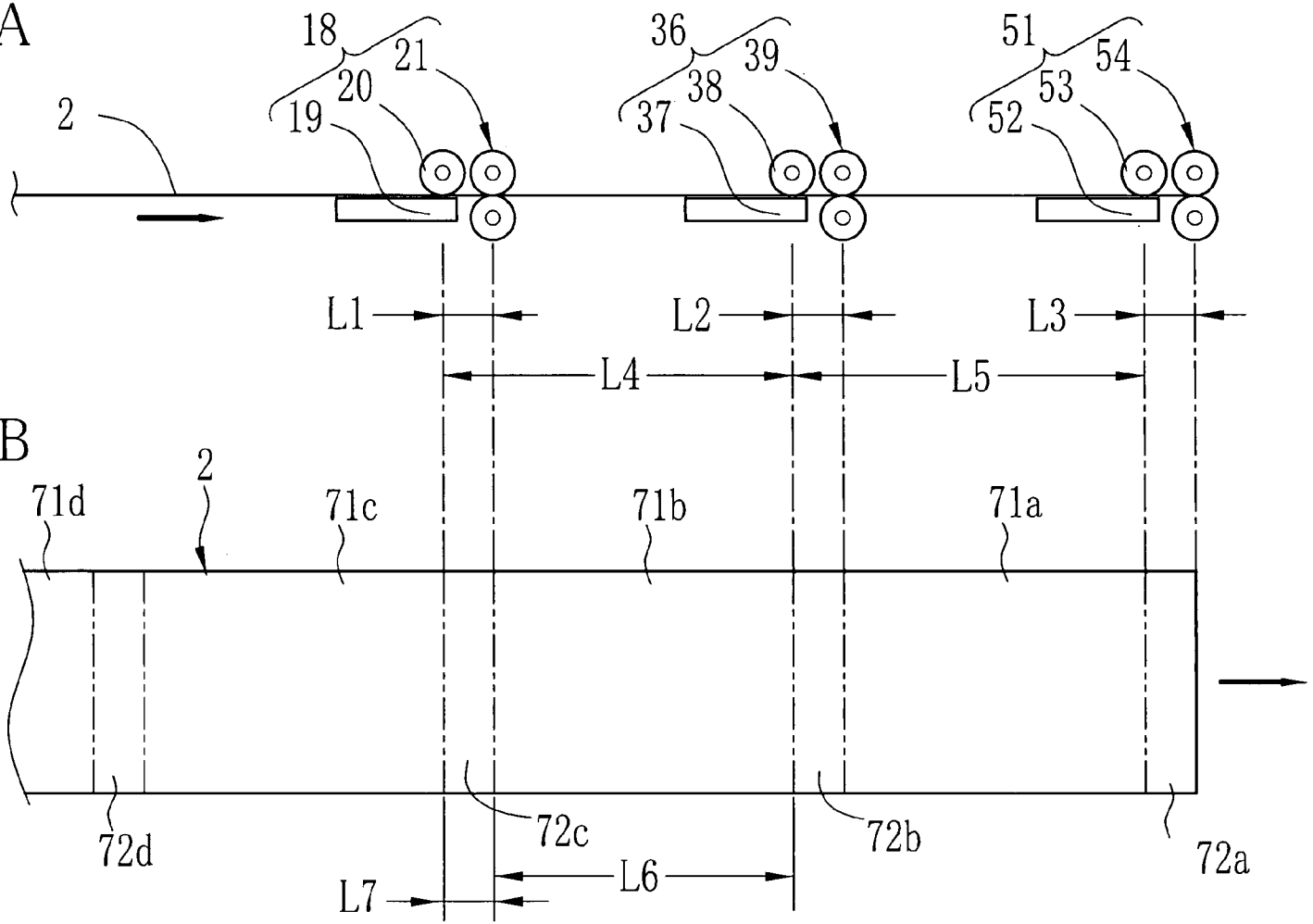
FIG. 3 is an explanatory view illustrating a relation between path length and recording area each printing unit in a state that transporting path of color thermal recording sheet is linearly developed.

FIG. 3A shows a state that a part of the transporting path for recording sheet 2 is straightened, in which the transporting path has bends in FIG. 1. In FIG. 3A, L1, L2 and L3 are common in distance (path length) along the transporting path of the thermal head and the front tension roller in the respective printing units 18, 36 and 51. Moreover, L4 and L5 are common in distance, which show intervals between thermal heads. In FIG. 3B, L4 and L5 respectively equal total length of L6 and L7, in which L6 is each length of recording areas 71*a* to 71*d* of recording sheet 2 and L7 is each length of margins 72*a* to 72*d* formed at the leading distal end of each of recording areas 71*a* to 71*d*. It means that when the cyan printing unit 51 is positioned in the margin 72*a*, the yellow printing unit 18 is positioned in another margin, the margin 72*c*.

The platen rollers 20, 38 and 53 are slightly deformed with heat created at the thermal heads 19, 37 and 52 respectively, thereby to cause fluctuation in the actual sheet transporting quantity of the recording area. For example, due to slight fluctuation in the transporting quantity in the yellow printing, the printing start position of the magenta image to print next deviates from that of the yellow image. Thereafter, due to slight fluctuation in the transporting quantity in the magenta printing, the printing start position of the cyan image to print next deviates from that of the magenta image. In the present invention, in order to prevent such registration deviation or error due to deformation of the platen rollers 20 and 38, the rotating speed fluctuation amount of the platen rollers 20 and 38 are detected based on output from the encoders 22 and 44, to determine the correcting quantity for the following printing start position.

Figure 4:
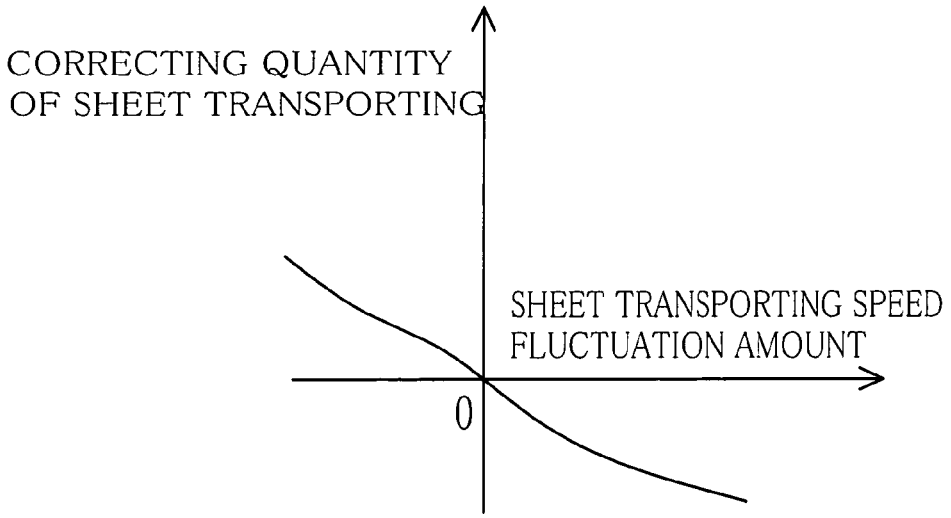
FIG. 4 is a graph illustrating an example of relation between transporting speed fluctuation amount and sheet transporting correction quantity.

FIG. 4 shows a graph which illustrates a relation between a transporting speed fluctuation amount of the platen roller and sheet transporting correction quantity for the printing start position of a color image to print next. The platen rollers 20 and 38 are of fixed relation between the transporting speed fluctuation amount and the transporting correction quantity. When the transporting speed of the platen rollers 20 and 38 increases, the actual transporting quantity is over the target-transporting quantity. Therefore, the transporting correction quantity is determined so that the actual sheet transporting quantity is in accordance with the target-transporting quantity, in which the correction quantity is a negative value. When the transporting speed of the platen rollers 20 and 38 decreases, the actual sheet transporting quantity is less than the target-transporting quantity. Therefore, the transporting correction quantity is determined so that the actual sheet transporting quantity is in accordance with the target-transporting quantity, in which the correction quantity is a positive value. The transporting speed fluctuation amount and the transporting correction quantity of the platen rollers 20 and 38 are calculated in advance by experimentally using an actual machine, to be stored in a memory 30*a* of the controller 30 in a form of look-up table.

Figure 5:
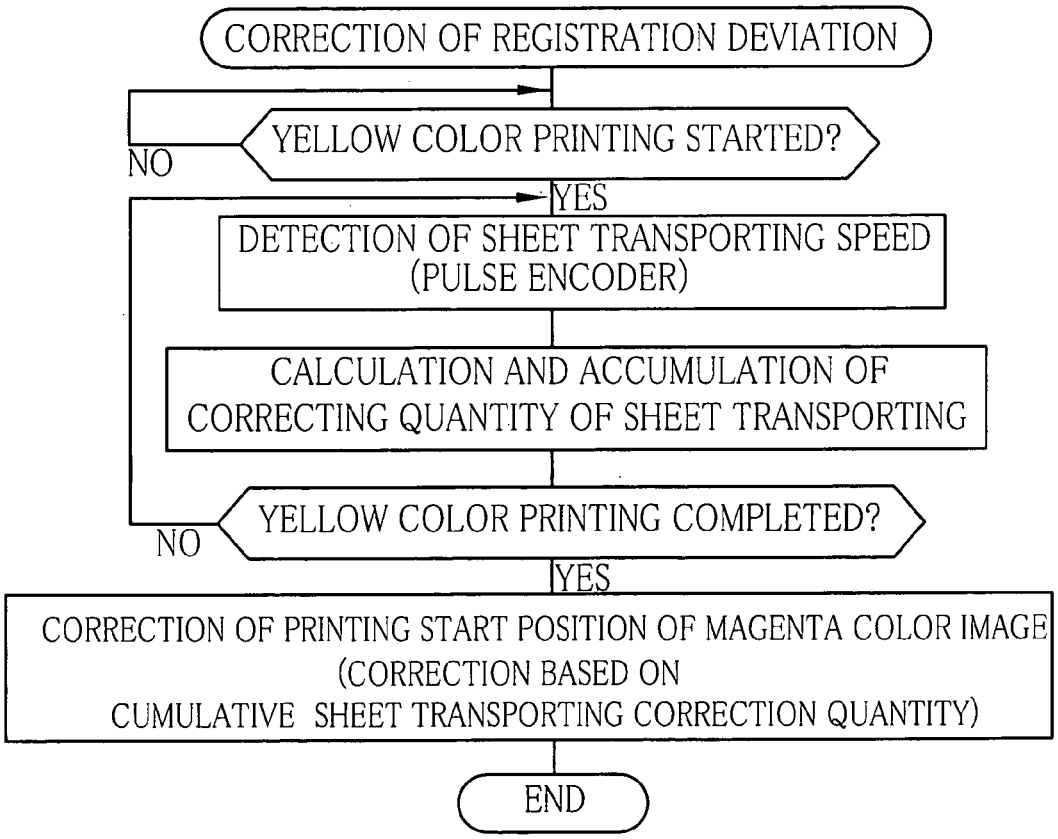
FIG. 5 is a flow chart illustrating correction processing of registration deviation.

In FIG. 5, the controller 30 detects the transporting speed fluctuation amount of the platen rollers 20 and 38 based on the interval between pulses output from each encoder 22 and 44, to serially determine the transporting correction quantity, according to relation shown in FIG. 4. The interval between the pulses is measured by use of the clock in the controller 30. The transporting correction quantity is summed or accumulated for the length of the recording area, to correct the target printing start position. Thereby, it is possible to suppress occurrence of the registration deviation which is caused by slight fluctuation in the sheet transporting quantity due to deformation of the platen rollers.

Figure 6:
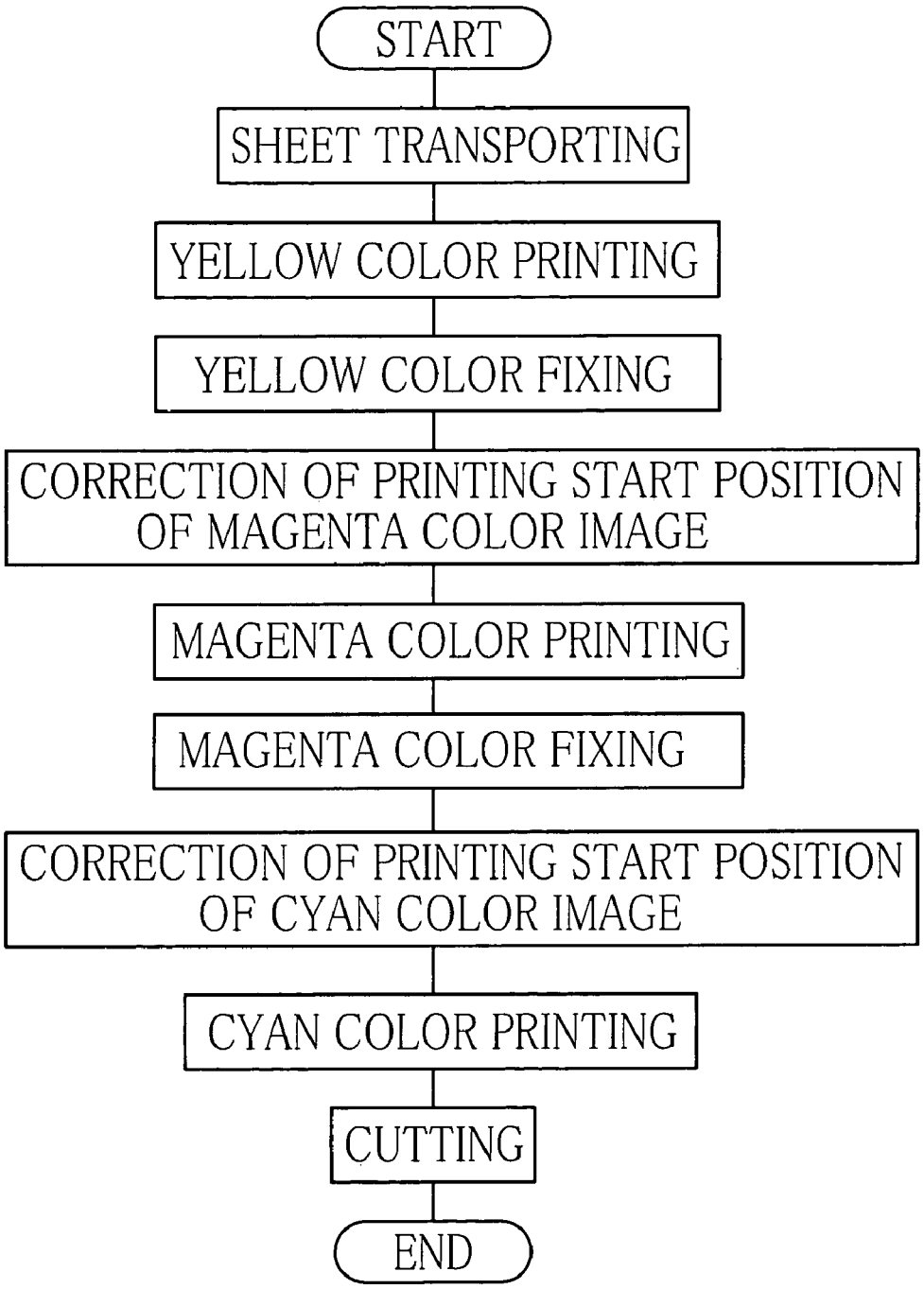
FIG. 6 is a flow chart illustrating printing processing.

Next, printing operation will be explained based on a flow chart in FIG. 6. When starting print operation, the stepping motor 5 starts its rotation at high supply speed. The yellow DC motor (Y-DCM) 28 starts its rotation at high printing speed.

The stepping motor 5 rotates the sheet supply roller 4 shown in FIG. 4 in the supply direction. Recording sheet 2 is pulled from the roll 3, to be transported downstream in the supply direction. When the distal end of recording sheet 2 is detected by a sensor Si disposed downstream of the back tension roller couple 12, the shift mechanism of the back tension roller couple 12 operates to press the pinch roller 15 on the capstan roller 14. Then, the DC motor 13 operates to rotate the-capstan roller 14 in the supply direction, to transport recording sheet 2 downstream in the supply direction.

The deviation of recording sheet 2 in the width direction is corrected via the aligning roller 11. When the distal end of recording sheet 2 passed through the transporting roller couple 7 is detected by a sensor S2 which is disposed downstream of the transporting roller couple 7, the shift mechanism of the transporting roller couple 7 operates to press the pinch roller 9 on the capstan roller 8. The transporting roller couple 7 rotates the capstan roller 8 in the supply direction, to transport recording sheet 2 downstream in the supply direction.

When the distal end of recording sheet 2 is transported to the yellow printing unit 18 and detected by a sensor S3 disposed downstream of the yellow front tension roller couple 21, the stepping motor 5 stops its rotation. The yellow DC motor 28 decreases its rotation at a roller setting speed which is slower than the printing speed.

The yellow pinch motor 31 rotates in accordance with detection of the distal end of recording sheet 2. The pinch roller 21*b* is moved to the capstan roller 21*a* by the yellow shift mechanism 29 to be pressed on the margin 72*a* of recording sheet 2. The yellow pinch sensor 32 detects movement of the pinch roller 21*b*, to output H level detecting signal.

The yellow DC motor (Y-DCM) 28 starts its rotation at the printing speed after movement of the pinch roller 21*b* and imposes tension on recording sheet 2 to remove the slack. Next, the yellow head motor 25 starts its operation. The thermal head 19 is moved to the recording position by the yellow head moving mechanism 23 to be pressed on the margin 72*a* of recording sheet 2. The yellow head sensor (Y-HS) 26 detects movement of the thermal head 19 to output H level signal.

When the distal end of the recording area 71*a* of recording sheet 2 reaches the thermal head 19, the thermal head 19 starts its operation to print yellow image on the yellow thermal coloring layer of recording sheet 2. When printing yellow image, front tension is imposed on the transporting roller couple 7 by the yellow front tension roller couple 21. The tension is larger than friction of contact between the thermal head 19 and recording sheet 2, in which the tension generates larger transporting quantity than the transporting roller couple 7. However, the transporting roller couple 7 controls the transporting quantity of the yellow front tension roller couple 21, so that the transporting speed downstream of the transporting roller couple 7 can be kept at that of the transporting roller couple 7.

The back tension roller couple 12 generates back tension as much as the yellow front tension roller couple 21. Thereby, tension applied to the transporting roller couple 7 is substantially 0 in real terms, so that transporting quantity of recording sheet 2 is kept within the range of safe bounds.

When printing yellow image, the rotating speed fluctuation amount of the platen roller 20 is detected by use of the pulse encoder 22 and the clock in the controller 30. The controller 30 determines the transporting correction quantity according to relation shown in FIG. 4 based on the detected rotating speed fluctuation amount of the platen roller 20, to serially sum the transporting correction quantity for the length of the recording area. The summed or cumulative transporting correction quantity is added to the target-transporting quantity for determining the printing start position of the magenta image to print next, to correct the following printing start position.

The yellow fixing lamp 34 is driven to emit simultaneous with printing of yellow image. The yellow fixing lamp 34 irradiates near ultraviolet rays in which the peak value is 420 nm, to fix the yellow thermal coloring layer of recording sheet 2.

When the distal end of recording sheet 2 is detected by a sensor S4 which is disposed downstream of the magenta front tension roller couple 39 of the magenta printing unit 36, rotating speed of the stepping motor 5 is shifted to a roller setting speed which is slower than the printing speed. Moreover, in accordance with pressure of the yellow thermal head 19 on recording sheet 2, the rotating speed of the magenta DC motor (M-DCM) 40 which has preparatorily started its rotation at the printing speed is shifted to the roller setting speed which is slower than the printing speed.

In accordance with shift of the stepping motor 5 to the roller setting speed, the magenta pinch motor (M-PM) 46 of the magenta printing unit 36 rotates. The magenta shift mechanism 45 presses the pinch roller 39*b* on the margin 72*b* of recording sheet 2 which is being moved at the roller setting speed. The magenta pinch sensor (M-PS) 47 detects movement of the pinch roller 39*b* and outputs H level detecting signal.

The magenta head motor (M-HM) 42 starts its rotation immediately after the rotation start of the magenta pinch motor (M-PM) 46. The magenta head moving mechanism 41 presses the thermal head 37 on the margin 72*a* of recording sheet 2 which is being moved at the roller setting speed. The magenta head sensor (M-HS) 43 detects movement of the thermal head 37 to output H level detecting signal. Note that since recording sheet 2 is transported at the roller setting speed when pressed by the magenta thermal head 37, tension by using the front tension roller couple 39 is not required prior to pressure by the thermal head 73.

When pressing the pinch roller 39*b* and the thermal head 37 on recording sheet 2, printing is not executed since the yellow printing unit 18 is positioned in the following margin 72*b*. Therefore, there occurs no density irregularity or color registration deviation due to shakes or shock when pressing the pinch roller 39*b* and the thermal head 37 on recording sheet 2.

Rotating speed of the stepping motors 5, the yellow DC motor (Y-DCM) 28 and the magenta DC motor (M-DCM) 40 is shifted to the printing speed from its roller setting speed after the thermal head 37 is pressed on recording sheet 2. When the distal end of the leading recording area 71*a* of recording sheet 2 reaches the thermal head 37, magenta image is printed on the recording area 71*a* and yellow image is printed on the following recording area 71*b*.

With reference to printing start of the magenta image, the transporting correction quantity is added to the target transporting quantity for determining the printing start position, to correct the following printing start position. Thereby, it is possible to suppress occurrence of the registration deviation caused by the transporting speed fluctuation of the platen rollers. Further, the rotating speed fluctuation amount of the platen roller 38 of the magenta printing unit 36 is determined based on output from the pulse encoder 44 when printing the magenta image. The controller 30 serially determines the transporting correction quantity corresponding to the rotating speed fluctuation amount based on the relation shown in FIG. 4, to serially sum the transporting correction quantity for the length of the recording area. The summed transporting correction quantity is added to the target transporting quantity for determining the printing start position of the cyan image to print next, to correct the following printing start position.

The yellow front tension roller couple 21 and the magenta front tension roller couple 39 respectively apply front tension to the transporting roller couple 7 when printing the yellow and magenta images. The back tension roller couple 12 stabilizes the transporting quantity of recording sheet 2 by generating back tension as much as front tension generated by the yellow front tension roller couple 21 and the magenta front tension roller couple 39.

At the same time as print of the yellow and magenta images, the yellow fixing lamp 34 and the magenta fixing lamp 49 are respectively driven to emit radiation, to fix the yellow and magenta thermal coloring layers.

When the distal end of recording sheet 2 is detected by a sensor S5 of the cyan printing unit 51, rotating speed of the stepping motor 5 is shifted to its roller setting speed. Moreover, the cyan DC motor (C-DCM) 62, the magenta DC motor (M-DCM) 40 and the yellow DC motor (Y-DCM) 28 which have preparatorily started their rotation at the printing speed are shifted to the roller setting speed.

In accordance with shift to the roller setting speed of the stepping motor 5, the cyan pinch motor (C-PM) 60 starts its rotation. The shift mechanism 57 presses the pinch roller 54*b* on the margin 72*a* of recording sheet 2 which is being transported. The cyan pinch sensor (C-PS) 61 detects the transportation of the pinch roller 54*b* to output H level detecting signal. The cyan head motor (C-HM) 58 starts its rotation immediately after the rotation of the cyan pinch motor 60. The cyan head moving mechanism 56 presses the thermal head 52 on the margin 72*a* of recording sheet 2 which is being transported. The cyan head sensor (C-HS) 59 detects movement of the thermal head 52 to output H level detecting signal. There occurs no density irregularity or color registration deviation due to shakes or shock when pressing the pinch roller 54*b* and the thermal head 52 on recording sheet 2 since the magenta printing unit 36 and the yellow printing unit 18 are positioned in the margins 72*b* and 72*c* respectively.

After pressing the thermal head 52 on recording sheet 2, the stepping motor 5, the yellow DC motor (Y-DCM) 28, the magenta DC motor (M-DCM) 40 and the cyan DC motor (C-DCM) 62 shift their rotating speed to the printing speed from the roller setting speed. When the distal end of the recording area 71*a* of recording sheet 2 reaches the thermal head 37, cyan, magenta and yellow images are respectively printed on the recording areas 71*a*, 71*b* and 71*c*. When printing the cyan image, the transporting correction quantity is added to the target transporting quantity for determining the printing start position, to correct the following printing start position. Thereby, it is possible to suppress occurrence of the registration deviation caused from the transporting speed fluctuation of the platen rollers.

The back tension roller couple 12 generates back tension as much as the front tension when printing the yellow, magenta and cyan images, to stabilize the transporting quantity of recording sheet 2. The yellow fixing lamp 34 and the magenta fixing lamp 49 are driven to emit radiation, to respectively fix the yellow and magenta thermal coloring layers.

Thus, recording sheet 2 on which yellow, magenta and cyan images are printed is transported to the cutter 65 by the cutter roller couple 67 which is driven by the stepping motor 69. The margin 72*a* and 72*b* which are distal ends of the recording area 71*a* are cut by the cutter 65, to form a sheet-shape color print. The sheet-shape color print is ejected outside the printer from the discharge opening 64 by the discharge roller couple 66.

According to the above embodiment, the platen roller of each printing unit is of same property, so that registration deviation caused when printing magenta and cyan images is corrected based on the relation between transporting speed fluctuation amount and transporting correction quantity illustrated in FIG. 4. The present invention is not intended to be limited to the above-described embodiments, and registration deviation may be corrected by storing in ROM 30*a* a table which shows relation between transporting speed fluctuation amount and transporting correction quantity, in which the relation is predetermined at each printing unit.

Further, according to the above embodiment, the sheet transporting speed of recording sheet 2 is decreased so that the thermal head and the pinch roller are pressed on the margin of recording sheet 2. However, the thermal head and the pinch roller may be pressed on the margin of recording sheet 2 by completely stopping the rotation of the stepping motor 5. In this case, it allows slack in recording sheet 2 due to stop of the transportation thereof. Accordingly, it is preferable to apply tension to recording sheet 2 pressed between the pinch roller and the thermal head.

When transportation of recording sheet 2 temporally stops in a state that, for example the yellow front tension roller couple 21 disposed upstream is pressed on recording sheet 2, a stain adhered on the yellow front tension roller couple 21 may be printed on recording sheet 2 to remain the nipped mark thereon. However, in pressing of the printing unit downstream on recording sheet 2, the front tension roller couple 21 upstream is positioned in the margin, so that there occurs no disadvantages even when the nipped mark is printed.

Moreover, if the platen rollers 20, 38 and 53 may be driven by DC motors 28, 40 and 62 for generating front tension, front tension roller couples 21, 39 and 54 may be omitted. In this case, occurrence of the registration deviation is suppressed by that the platen rollers 20 and 38 are provided with the pulse encoders 22 and 44 respectively, to detect fluctuation in the transporting quantity caused by such as the heating deformation of the platen rollers 20 and 38 and to correct the transporting quantity.

Furthermore, according to the above embodiment, L4 and L5, showing intervals between the respective printing units 18, 36 and 51, are of same distance as the total distance of L6 and L7, shown in FIG. 3. However, L4 and L5 may have distance which is a multiple of an integer of the total length of L6 and L7.

In the above embodiment, the example of the color thermal printer is explained. However, the present invention may be performed for a dye-sublimation color printer and a thermal wax transfer printer.

Although the present invention has been fully described by the way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A color thermal printer for recording full color image by recording one color image at each of printing units during transportation of a long recording sheet by a couple of transporting rollers, a plurality of said printing units being disposed along the transporting path, each of said printing units including a platen roller for supporting said long recording sheet, and a thermal head for executing thermal recording of each color image by pressing said recording sheet which is supported by said platen roller, said color thermal printer comprising:

a rotating speed detector disposed on at least one said platen roller for detecting rotating speed of the at least one said platen roller; and a controller for recording image by driving said thermal head of each printing unit when transporting quantity of said recording sheet transported by said transporting roller couple reaches target value corresponding to the recording start position, the controller calculating the transporting correction quantity of said recording sheet from the rotating speed fluctuation amount of the at least one said platen roller, to correct said target value so as to correspond to the recording start position of a directly downstream printing unit.

2. A color thermal printer as claimed in claim 1, further comprising a memory for storing data table in which said rotating speed fluctuation amount is associated with said transporting correction quantity.

3. A color thermal printer as claimed in claim 2, wherein said controller obtains said correction value by detecting said rotating speed fluctuation amount at each fixed period of time, calculates a cumulative correction quantity by accumulating the correction quantity during recording of said image, to correct said target value according to said cumulative correction quantity so as to correspond to the recording start position of said directly downstream printing unit.

4. A color thermal printer as claimed in claim 2, wherein said rotating speed detector is a pulse encoder which outputs pulse signal according to the rotating amount of the at least one said platen roller.

5. A color thermal printer as claimed in claim 4, wherein said pulse encoder includes a disk-shaped slit plate formed with a plurality of slits which extends in a radial direction and a photoelectric sensor of a transmission type for detecting passage of said slits to output said pulse signal.

6. A color thermal printer as claimed in claim 2, wherein first, second and third printing units are disposed from upstream of said transporting path in sequence on one another for respectively recording yellow, magenta and cyan images, and said rotating speed detector is provided on the at least one said platen roller of said first and second printing units.

7. A color thermal printer as claimed in claim 1, wherein the controller is configured to receive the rotating speed of the at least one said platen roller from the rotating speed detector.

8. A color thermal printer as claimed in claim 1, wherein said controller obtains said correction value by detecting said rotating speed fluctuation amount at each fixed period of time, calculates a cumulative correction quantity by accumulating the correction quantity during recording of said image, to correct said target value according to said cumulative correction quantity so as to correspond to the recording start position of said directly downstream printing unit.

9. A color thermal printer as claimed in claim 1, wherein first, second and third printing units are disposed from upstream of said transporting path in sequence on one another for respectively recording yellow, magenta and cyan images, and said rotating speed detector is provided on the at least one said platen roller of said first and second printing units.

10. A color thermal printer as claimed in claim 1, further comprising a front tension roller disposed downstream of the thermal head of each of the said printing units, wherein said tension roller is configured to rotate faster than said transporting roller couple when transporting said recording sheet.

11. A color thermal printer as claimed in claim 10, further comprising a back tension roller, disposed upstream of said transporting roller couple, which applies back tension to said recording sheet.

12. A color thermal printer as claimed in claim 1, further comprising an aligning roller, disposed upstream of said transporting roller couple, which corrects deviation in a widthwise direction of said recording sheet.

13. A color thermal printer as claimed in claim 1, further comprising a color fixing lamp disposed downstream of at least one of said printing units.

14. A color thermal printing method of recording full color image by recording one color image at each of printing units during transportation of a long recording sheet by a couple of transporting rollers, a plurality of said printing units being disposed along the transporting path, each of said printing units including a platen roller for supporting said long recording sheet, and a thermal head for executing thermal recording of each color image by pressing said recording sheet which is supported by said platen roller, said color thermal printing method comprising the steps of:

determining whether transporting quantity of said recording sheet by said transporting roller couple reaches target value corresponding to the recording start position;

when said transporting quantity reaches said target value, recording image by driving said thermal head of each printing unit;

detecting rotating speed of at least one said platen roller;

calculating the transporting correction quantity of the said recording sheet from rotating speed fluctuation amount of said platen roller; and correcting said target value so as to correspond to a recording start position of a directly downstream printing unit.

15. A color thermal printing method as claimed in claim 14, wherein in said correction quantity calculating step, a data table is used, and has data of said rotating speed fluctuation amount and said transporting correction quantity associated therewith.

16. A color thermal printing method as claimed in claim 15, further comprising the steps of:

obtaining said correction quantity by detecting said rotating speed fluctuation amount at a fixed period of time;

calculating a cumulative correction quantity by accumulating said correction quantity during recording of said image; and correcting said target value according to said cumulative correction quantity, so as to correspond to the recording start position of said directly downstream printing unit.

17. A color thermal printing method as claimed in claim 15, wherein in said speed detecting step, a rotating amount of the at least one said platen roller is detected in a stepwise manner.

18. A color thermal printing method as claimed in claim 17, wherein in said speed detecting step, a pulse encoder is used for detecting said rotating amount photoelectrically.

19. A color thermal printing method as claimed in claim 15, wherein first, second and third printing units are disposed from upstream of said transporting path in sequence on one another for respectively recording yellow, magenta and cyan images;

in said speed detecting step, said rotating speed in said first and second printing units is detected.

20. A color thermal printing method as claimed in claim 14, further comprising the steps of:

obtaining said correction quantity by detecting said rotating speed fluctuation amount at a fixed period of time;

calculating a cumulative correction quantity by accumulating said correction quantity during recording of said image: and correcting said target value according to said cumulative correction quantity, so as to correspond to the recording start position of said directly downstream printing unit.

21. A color thermal printing method as claimed in claim 14, wherein first, second and third printing units are disposed from upstream of said transporting path in sequence on one another for respectively recording yellow, magenta and cyan images;

in said speed detecting step, said rotating speed in said first and second printing units is detected.

22. A color thermal printing method as claimed in claim 14, further comprising:

imposing front tension on said recording sheet when recording the one color image, using a front tension roller disposed downstream of the thermal head of each of the said printing units, wherein the tension roller is configured to rotate faster than said transporting roller couple; and controlling said transporting quantity when recording the one color image, using said transporting roller couple so that speed of transporting said recording sheet can be kept at rotating speed of said transporting roller couple.

23. A color thermal printing method as claimed in claim 22, further comprising imposing back tension on said recording sheet when recording the one color image, using a back tension roller disposed upstream of said transporting roller couple, wherein said back tension is the same as said front tension so that no extra tension is applied on said recording sheet by said transporting roller couple.

* * * * *